US008523098B2

(12) United States Patent
Detweiler

(10) Patent No.: US 8,523,098 B2
(45) Date of Patent: Sep. 3, 2013

(54) CORD ORGANIZER

(76) Inventor: Sean D. Detweiler, Concord, MA (US)

( * ) Notice: Subject to any disclaimer, the term of this patent is extended or adjusted under 35 U.S.C. 154(b) by 0 days.

(21) Appl. No.: 13/702,938

(22) PCT Filed: Jun. 10, 2011

(86) PCT No.: PCT/US2011/039981

§ 371 (c)(1),
(2), (4) Date: Feb. 7, 2013

(87) PCT Pub. No.: WO2011/156712

PCT Pub. Date: Dec. 15, 2011

(65) Prior Publication Data

US 2013/0126661 A1 May 23, 2013

Related U.S. Application Data

(60) Provisional application No. 61/354,137, filed on Jun. 11, 2010.

(51) Int. Cl.
*B65H 75/38* (2006.01)

(52) U.S. Cl.
USPC ..... 242/404.3; 242/400.1; 242/405.1

(58) Field of Classification Search
USPC ..... 242/400.1, 404.3, 405, 405.1, 406, 242/588, 588.1
See application file for complete search history.

(56) References Cited

U.S. PATENT DOCUMENTS

| | | | | |
|---|---|---|---|---|
| 4,277,035 | A * | 7/1981 | Gaski | 242/404.3 |
| 5,513,816 | A * | 5/1996 | Grubb | 242/398 |
| 6,484,787 | B1 * | 11/2002 | Walters | 160/178.1 R |
| 7,048,222 | B1 * | 5/2006 | Curtiss | 242/405.1 |
| 7,455,258 | B2 * | 11/2008 | Proebstle | 242/404.3 |
| 2004/0035972 | A1 * | 2/2004 | Glass | 242/388.6 |
| 2007/0181514 | A1 | 8/2007 | Mantey | |
| 2011/0220754 | A1 * | 9/2011 | Merten et al. | 242/400.1 |

FOREIGN PATENT DOCUMENTS

| | | | |
|---|---|---|---|
| JP | 3016521 | U | 7/1995 |
| JP | 3113465 | U | 7/2005 |
| KR | 20-0315307 | Y1 | 6/2003 |
| KR | 20-0423708 | Y1 | 8/2006 |

OTHER PUBLICATIONS

International Search Report for International Application PCT/US2011/039981, dated Jan. 2, 2012.

* cited by examiner

*Primary Examiner* — Sang Kim
(74) *Attorney, Agent, or Firm* — Sean D. Detweiler, Esq.; Morse, Barnes-Brown & Pendleton, P.C.

(57) ABSTRACT

A cord organizer has a base with first and second posts extending therefrom. First and second flexible nubs couple with the first post and the second post, respectively. The result is a cord organizer formed of two posts around which a cord may be wrapped in a figure-eight pattern. The flexible nubs help to hold the cord onto the posts by preventing the cord from slipping off the ends of the posts on its own. However, when the cord is to be un-stowed from the cord organizer, the cord can be pulled straight away from the cord organizer, causing the flexible nubs to elastically flex to allow the cord to pass without requiring undue pivoting or rotating of the cord organizer, and further without causing twisting of the cord about its longitudinal central axis. The flexible nubs may be removable and replaceable to enable personalized customization of the cord organizer.

13 Claims, 6 Drawing Sheets

CORD ORGANIZER

RELATED APPLICATIONS

This application is a national stage filing under 35 U.S.C. 371 of International Application No. PCT/US2011/039981, filed Jun. 10, 2011, which claims priority to, and the benefit of, co-pending U.S. Provisional Application 61/354,137, filed Jun. 11, 2010, for all subject matter common to both applications. The disclosures of said applications are hereby incorporated by reference in their entirety. International Application No. PCT/US2011/039981, was published under PCT Article 21(2) in English.

FIELD OF THE INVENTION

The present invention relates to a device suitable for stowing cords, and more particularly, to a device configured to stow cords, and the like, in such a way that the cord is not twisted about its longitudinal central axis, and can be easily un-stowed from the stowed position without resulting in twisting the cord.

BACKGROUND OF THE INVENTION

The twisting and tangling of cords associated with headphones and earphones is a recurring problem. Many different cord organizers attempt to make it easy to neatly stow and un-stow cords. Unfortunately, many organizers fall short of being easy to stow the cord, or they provide an easy method for stowing the cord but the recurring use of the organizers causes extensive twisting of the cord.

One conventional cord organizer is simply an oblong shape around which the cord is wrapped, and thereby stowed. However, this device requires that the cord be wrapped around it for stowage. To un-stow the cord, the device can itself be rotated about an imaginary axis (like a yo-yo) to remove the cord. However, this is not easy to manage, and most users instead hold the device in a fixed position and pull on the cord to unravel it off the end of the shape. This results in un-stowing the cord from the device quickly, but also results in the cord being twisted about its own longitudinal central axis during removal. Accordingly, after removal, the cord remains twisted and can self-loop itself (i.e., fail to hang straight, but instead be inclined to form loops due to the twisted nature of the cord), or can be unwieldy to handle. Repeated stowing and un-stowing of the cord amplifies the twisting and self-looping of the cord, unless and until the user takes additional steps to un-twist the cord. Such repeated twisting is also detrimental to the longevity of the cord.

Other devices are known for organizing cords, including clips, wraps, folios, ties, and the like. However, each device has its own drawbacks, including excessive twisting of the cord, and/or an overly complex and time-consuming processes for stowing or un-stowing the cord from the device.

SUMMARY

There remains a need for an improved cord organizer that provides the user with an easy and quick process for stowing the cord, and an easy and quick process for un-stowing the cord, while also not causing the twisting of the cord about its longitudinal central axis with each cycle of stowing and un-stowing. The present invention is directed toward further solutions to address this need, in addition to having other desirable characteristics.

In accordance with one aspect of the present invention, a cord organizer includes a base having a bottom surface and a top surface. A first post extends outward from the top surface of the base. A second post extends outward from the top surface of the base. A first flexible nub mounts to the first post. A second flexible nub mounts to the second post. The first flexible nub can be removably and replaceably mounted to the first post, and the second flexible nub can be removably and replaceably mounted to the second post. The first and second flexible nubs can be configured in such a way as to extend outward from the first and second posts, respectively, at post ends distal from the base forming a ledge hindering a cord wrapped about the first and second posts from sliding off an end of the first and second posts opposite the base while also having sufficient flexibility to substantially remove the ledge by a flexing action out of the way when the cord wrapped about the first and second posts is forcibly pulled off of the cord organizer.

In accordance with aspects of the present invention, the first and second posts extend substantially perpendicularly from the top surface of the base. The first and second posts can alternatively extend outward and at a non-perpendicular angle from the top surface of the base. The first and second flexible nubs can extend outward from the first and second posts, respectively, at post ends distal from the base, each forming the ledge.

In accordance with further aspects of the present invention, the cord organizer further can include a clip integral therewith or attached thereto. The first and second flexible nubs can be removable and replaceable onto the first and second posts. At least one mounting slot can be disposed in a top portion of the first flexible nub, the second flexible nub, or both. A first mounting slot and a second mounting slot can be disposed in the first flexible nub, the second flexible nub, or both. The cord organizer can include one, two, three, or four mounting slots. A first base mounting slot can be placed proximal a base portion of the first post. A second base mounting slot can be placed proximal a base portion of the second post. A hollow channel can pass through at least one of the first and second posts along a central axis thereof. A fastener can be removably coupled with the hollow channel to mount a component to the cord organizer.

BRIEF DESCRIPTION OF THE FIGURES

These and other characteristics of the present invention will be more fully understood by reference to the following detailed description in conjunction with the attached drawings, in which.

DETAILED DESCRIPTION

Figure 1A:
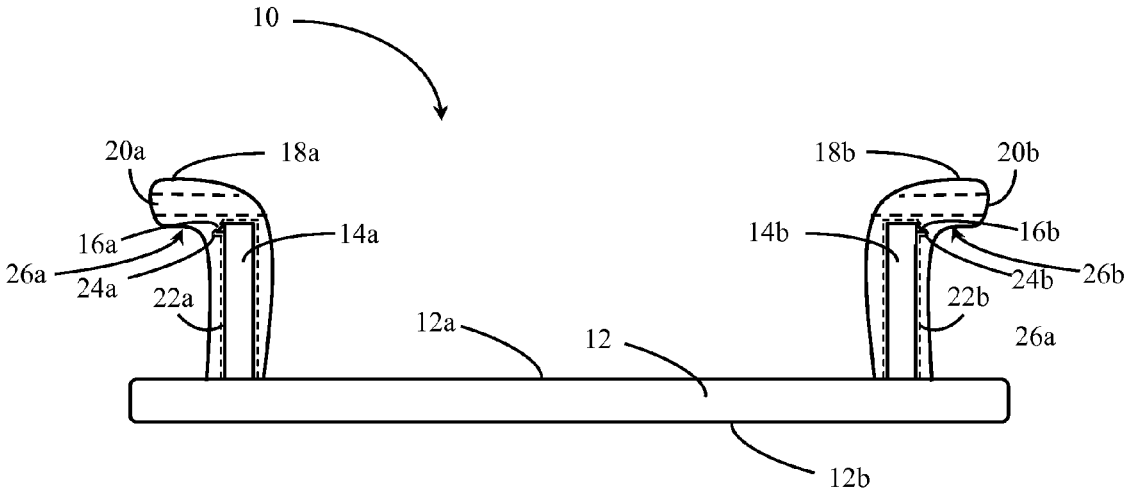
FIG. 1A is a side view of the cord organizer, according to one embodiment of the present invention.

An illustrative embodiment of the present invention relates to a cord organizer having a base. The base has at least a bottom surface and a top surface. First and second posts extend from the top surface of the base. The first and second posts are distal from each other a desired amount. First and second flexible nubs are mounted to the first post and the second post, respectively. The first and second flexible nubs are located at opposite ends of the posts from the base, and each extends substantially outward from the posts and in a direction opposite and away from the other flexible nub. The result is a cord organizer device formed of two posts around which a cord may be wrapped in a figure-eight pattern. The flexible nubs at the ends of each post assist in holding the cord onto the posts by preventing the cord from slipping off the ends of the posts on its own. However, when the cord is to be un-stowed from the cord organizer, the cord can be pulled straight away from the cord organizer. As the cord is pulled, the flexible nubs flex to allow the cord to pass without requiring a user of the cord organizer to excessively pivot or rotate the cord organizer to enable the cord to slip past the flexible nubs at the ends of the posts. Due to the figure-eight pattern that is utilized to stow the cord, the act of un-stowing the cord from the cord organizer does not result in twisting the cord about its longitudinal central axis with each repetition of stowing and un-stowing. In addition, the flexible nubs are removable and replaceable by a user, enabling the swapping of the nubs with different nubs having, for example, different shapes, sizes, designs, and/or colors, in such a way so as to create an opportunity for personal customization by the user.

FIGS. 1A through 9, wherein like parts are designated by like reference numerals throughout, illustrate example embodiments of a cord organizer according to the present invention. Although the present invention will be described with reference to the example embodiments illustrated in the figures, it should be understood that many alternative forms can embody the present invention. One of skill in the art will additionally appreciate different ways to alter the parameters of the embodiments disclosed, such as the size, shape, or type of elements or materials, in a manner still in keeping with the spirit and scope of the present invention.

Figure 1B:
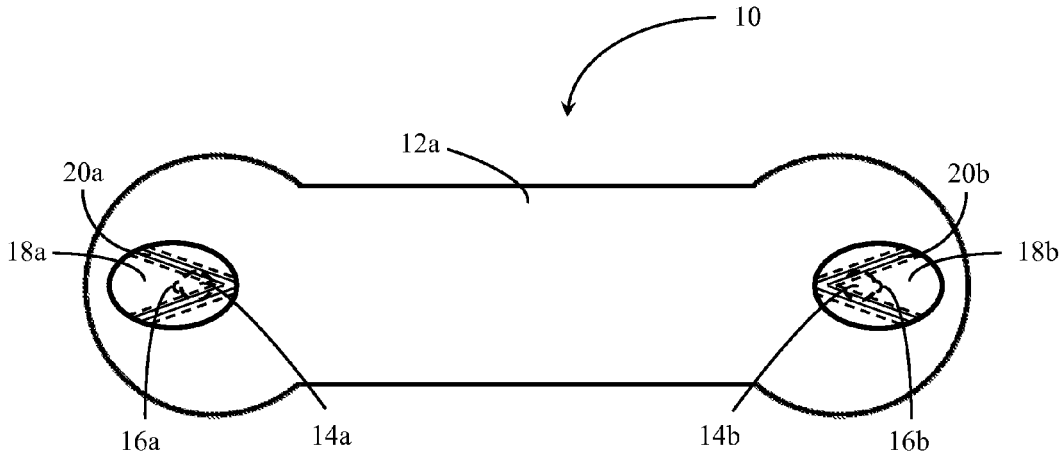
FIG. 1B is a top view of the cord organizer, according to one aspect of the present invention.

Turning first to FIGS. 1A and 1B, and the remaining figures, the present invention will now be described. A cord organizer 10 in accordance with the present invention includes a base 12 having a bottom surface 12*b* and a top surface 12*a*. The bottom and top surfaces 12*b*, 12*a* can be flat, rounded, curved, convex, concave, and the like, and can have one or more of different textures, including smooth, rough, patterned, and the like. The base is formed of a hard or rigid material, including but not limited to wood, plastic, composite, metal, rubber, synthetic or natural materials, and the like. One of skill in the art will appreciate that any number of different hard and/or rigid materials may be utilized, such that the present invention is by no means limited to those specifically listed herein.

A first post 14*a* and a second post 14*b* each extend outward from the top surface 12*a* of the base 12. In the example embodiment, each of the first and second posts 14*a,b* is substantially similar, and will be described simultaneously herein. The first and second posts 14*a,b* can be separate components that are mounted to the base 12, or they can be formed integrally with the base 12. If they are mounted, they can be mounted using any number of conventional mounting techniques, including by adhesive, mechanical fastener, friction fit, and the like. The length of the posts may vary, depending on the amount of cord that is designated for stowage on the cord organizer 10, and the corresponding thickness and height of the cord when wrapped around the posts 14*a,b*. Likewise, the size of the base 12 may vary depending on the size of the cord desired for stowage as well. The first and second posts 14*a,b*, must be sufficiently rigid and sufficiently mounted to the base 12 such that when a cord is wrapped around the posts 14*a,b*, they do not separate from the base 12 under the forces applied to them by such a process, as would be understood by those of skill in the art. Furthermore, the length of the base 12 and the distance between the posts 14*a,b* can be sized and dimensioned to accommodate a desired length of cord as it is wrapped around the posts 14*a,b* and stowed as described herein. One of skill in the art will appreciate that a greater distance between posts 14*a,b* will enable a longer length of cord to be wrapped between the posts 14*a,b* in a relatively fewer number of times. Likewise a shorter distance between the posts 14*a,b* will require a greater number of passes by the same length of cord. For example, a cord organizer 10 designed for an earphone cord may have a distance between posts 14*a,b* of, e.g., between 1 to 3 inches (2.54 to 7.62 centimeters), generally, while a cord organizer 10 designed for an extension cord may have a distance between posts of, e.g., 1-2 feet (0.3048-0.6096 meter), generally. Likewise the size of the posts 14*a,b* will vary from, e.g. 0.25 to 1.0 inches (0.635 to 2.54 centimeter), generally for an earphone cord, or, e.g., 3 to 6 inches (7.62 to 15.24 centimeters), generally for an extension cord. One of skill in the art will appreciate that these dimensions are merely illustrative of scale, not of specific ranges to which the present invention must be held. More specific dimensions can readily be determined based on the particular application for the cord organizer 10 being manufactured. Furthermore, it is anticipated that the base 12 of the cord organizer can be configured to be adjustable lengthwise, thus enabling a user to set the distance between the posts to a desired distance within a predetermined range.

In addition, the posts 14*a,b* may have different cross-sectional shapes, including circular, elongate, oval, rectangular, square, irregular, trapezoidal, octagonal, or other geometric shapes able to be formed into posts. The post 14*a,b*, can likewise be solid, or can be hollow, having a channel formed therein, which may be further utilized in mounting the cord organizer 10 to a surface or in mounting an accessory to the cord organizer 10.

At the top of each post 14*a,b* (i.e., at the end opposite that of the base 12) a surface feature 16*a,b* is provided. The surface feature 16*a,b* in accordance with one example embodiment of the present invention extends outwardly from the post 14*a,b* and is utilized as a fastening mechanism as described later herein. The surface feature 16*a,b* can extend in one or more directions from the top of the post, or can be a segmented or continuous feature for the entire perimeter around the top of the post 14*a,b*, as further described herein.

The post 14*a,b* can be partially or completely covered with a flexible nub 18*a,b* mounted thereon, The flexible nub 18*a,b* includes a mounting slot 20*a,b*, in accordance with one example embodiment of the present invention. The mounting slot 20*a,b* is disposed along a top portion of the flexible nub 18*a,b* in accordance with one example embodiment of the present invention. The flexible nub 18*a,b* further includes a hollow sleeve 22*a,b* sized and dimensioned to fit snugly over the post 14*a,b*, resulting in a friction fit. The hollow sleeve 22*a,b* can extend completely to the base 12, or can extend for only a sub-portion of the length of the post 14*a,b* (e.g., at an upper portion of the post).

The hollow sleeve 22*a,b* can further include a catch 24*a,b* sized to fit over the surface feature 16*a,b* in such a way that the surface feature 16*a,b* latches with the catch 24*a,b*. When placed in the mounted position onto the post 14*a,b*, the friction fit of the hollow sleeve 22*a,b* works in conjunction with the catch 24*a,b* latching with the surface feature 16*a,b* to hold the flexible nub 18*a,b* onto the post 14*a,b* in a static manner. One of skill in the art will appreciate that the surface feature 16*a,b* and the catch 24*a,b* are sized and dimensioned to work in conjunction with each other to hold the flexible nub 18*a,b* onto the post 14*a,b*. As such, each may vary in length and magnitude, may be disposed on a portion of the post 14*a,b* and flexible nub 18*a,b*, may be disposed in a plurality of locations around the post 14*a,b* and flexible nub 18*a,b*, or may extend partially or fully around the post 14*a,b* and flexible nub 18*a,b*. Furthermore it is anticipated that other mechanical fastening means may be utilized to fasten the flexible nub 18*a,b* to the post 14*a,b*, as would be understood by those of skill in the art. What is required is that the flexible nub 18*a,b* be removably fastened with the post 14*a,b* in a manner compliant with predictable mechanical fastening means, if not by the means specifically described herein. Furthermore, the flexible nub 18*a,b* must remain on the post during operation of the device, especially when stowing and un-stowing the cord, but still be removable by a user if desired. The present invention anticipates that for at least aesthetic purposes, the flexible nub 18*a,b* may be the same or different color or pattern from the base 12, and it may be a personal preference of a user as to what the colors of the various components are for the cord organizer. Furthermore, the user may choose to swap out flexible nubs 18*a,b* having different colors, patterns, designs, ornamental variations, and the like, to change the overall look of the cord organizer 10 depending on personal user customization preferences. Likewise, there may be nubs designed having different or varied structural characteristics. As such, the ability to swap out the nub for structural preferences is also anticipated by the present invention, to provide further personal customization possibilities by a user.

Furthermore, the surface feature 16*a,b* may serve to prevent or at least substantially hinder rotation of the flexible nub 18*a,b* about a central axis of the post 14*a,b*. Alternatively, other structures may be placed along the post 14*a,b* to act as a locking key to hold the flexible nub 18*a,b* in place and preventing its rotation about the post 14*a,b*. Likewise, the shape of the post 14*a,b* (e.g., having a cross-sectional shape with corners, an elongated side, or a key) may be utilized to hinder rotation of the flexible nub 18*a,b* about the post, and may also be utilized to indicate to a user which direction to mount the flexible nub 18*a,b* onto the post 14*a,b*.

The flexible nub 18*a,b* of the illustrative embodiment has a generally elbow shape, such that the hollow sleeve 22*a,b* fits over the post 14*a,b* and the elbow shape of the nub is oriented in an upper portion of the flexible nub 18*a,b* extending substantially perpendicularly outwardly from the top of the post 14*a,b* toward an end of the cord organizer 10. The generally elbow shape of the flexible nub 18*a,b* serves to form a ledge 26*a,b* that serves as a stop to hinder a cord wrapped around the post 14*a,b* and the flexible nub 18*a,b* from easily sliding off the end when not desired. In other words, absent the ledge 26*a,b* being there, a cord may easily slide off the end of the post 14*a,b*. With the existence of the ledge 26*a,b*, there is a hindrance to a cord easily sliding off the end of the post 14*a,b*. However, the hindrance is not such that a cord may not be pulled off of the post 14*a,b* by a user in such a way that causes the flexible nub 18*a,b* to flex and give-way, essentially bending from its generally elbow shape to be generally more in line with the central axis of the post 14*a,b*, thus allowing the cord to slide off, when desired, as described later herein.

In accordance with one example embodiment of the present invention, the flexible nub 18*a,b* is made of a generally flexible material that can withstand repeated flexing and cords sliding across the surface of the flexible nub 18*a,b* without tearing, fracturing, pilling, or generally degrading in some manner. The material must be capable of significant and repeated deformation without breaking. An example material suitable for forming the flexible nub includes, but is not limited to, a foamable ethylene vinyl acetate (EVA) along with polyolefin elastomer (e.g., Engage™ polyolefin elastomer from Dow Chemical Company), optionally further including a pigment to color the material in any of a number of different desired colors or patterns. Another example material may be a urethane based material well known in the engineering arts. The material is preferably lightweight as well, so that the overall weight of the cord organizer 10 is kept as low as possible, in accordance with one example embodiment, such that if the organizer 10 is suspended on a cord it does not pull excessively due to its weight. Other composite, plastic, rubber, or synthetic materials having similar properties to the flexible materials specified herein are also anticipated for use with the present invention to form the flexible nub 18*a,b*. As would be well understood by those of skill in the art, the materials can be selected to have desired durometers to provide the preferred amount of flexibility to operate as described herein. For example, the flexible nub 18*a,b* could have a durometer of between about 25 and 100 Shore A scale, including 25 A, 30 A, 35 A, 40 A, 45 A, 50 A, 55 A, 60 A, 65 A, 70 A, 75 A, 80 A, 85 A, 90 A, 95 A, 100 A, and any durometer therebetween. Example embodiments have been tested at 30 A, 40 A, and 60 A, each of which has proven operable but with performance distinctions that can be specified as preferred for a particular implementation by one of skill in the art. As such, the present invention is not limited to said experimentally tested durometers. An alternative configuration can be formed of a mechanically hinged mechanism (not shown) having spring or other mechanisms to enable the ledge 26*a,b* to swing or flex away in similar fashion to the flexible material, and then return to its original position.

Figure 2:
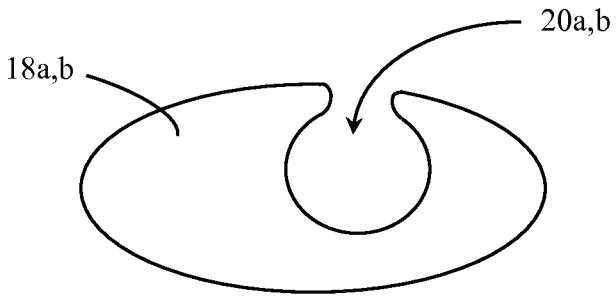
FIG. 2 is an end perspective view of a flexible nub, according to one aspect of the present invention.

FIG. 2 shows an end view of a top portion of the flexible nub 18*a,b*. The nub includes the mounting slot 20*a,b* into which a cord may be placed and frictionally held in place to prevent the cord from unraveling from the cord organizer 10. In operation, the cord is pressed into the mounting slot 20*a,b* and frictionally held in place until removal is desired, at which point the cord may be pulled back through the top of the mounting slot 20*a,b*. Because the mounting slot is made of flexible material, this method for storing the end of a cord, or even an interim length, is easily effected.

Figure 3:
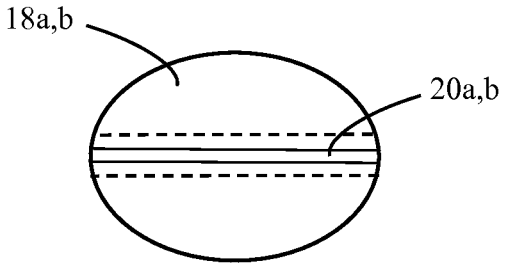
FIG. 3 is a top view of a flexible nub, containing a mounting slot, according to one aspect of the present invention.

FIG. 3 is a top view of the flexible nub 18*a,b*, in accordance with one example embodiment of the present invention. Also shown is the mounting slot 20*a,b* passing through a length of the flexible nub 18*a,b*.

Figure 4A:
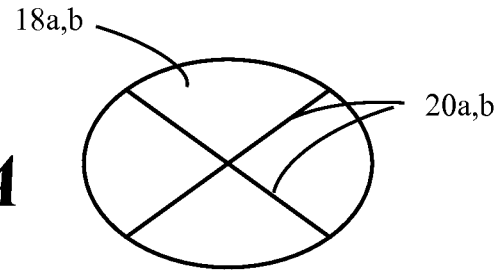
FIG. 4A is a diagrammatic illustration of a pattern of mounting slots at the top of a flexible nub, according to one embodiment of the present invention.
Figure 4B:
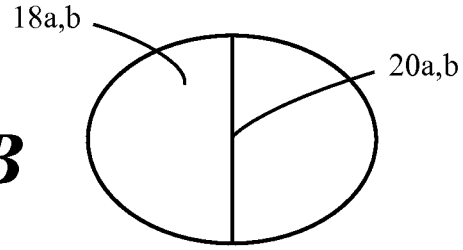
FIG. 4B is a diagrammatic illustration of a pattern for mounting slots at the top of a flexible nub, according to one embodiment of the present invention.
Figure 4C:
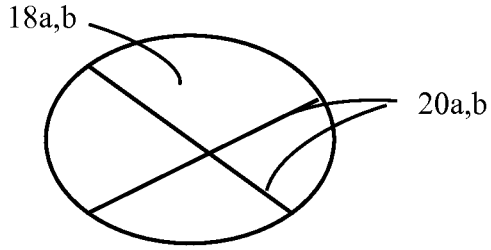
FIG. 4C is a diagrammatic illustration of a pattern for mounting slots at the top of a flexible nub, according to one embodiment of the present invention.
Figure 4D:
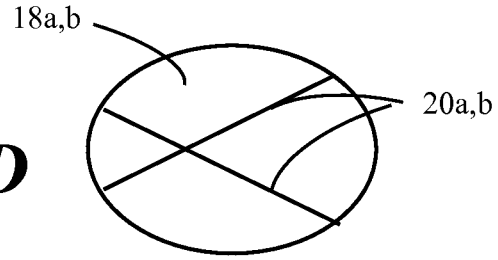
FIG. 4D is a diagrammatic illustration of a pattern for mounting slots at the top of a flexible nub, according to one embodiment of the present invention.

One of skill in the art will appreciate that the mounting slot 20*a,b* can be formed in the flexible nub 18*a,b* in a number of different patterns and quantities. For example as shown in FIG. 3, a single mounting slot 20*a,b* is shown passing straight through the flexible nub 18*a,b*. As shown in FIGS. 4A, 4B, 4C, and 4D, alternative configurations of mounting slots 20*a,b* are possible. The mounting slots 20*a,b* may intersect, and they may intersect in a symmetrical "X" pattern or an offset "X" pattern (offsetting the intersection toward one end or the other of the flexible nub 18*a,b*), or a "V" pattern (as shown in FIG. 5B). The mounting slot 20*a,b* may further be in line with a central axis of the overall base 12 length (as in FIG. 3), or may be substantially perpendicular to this orientation (as shown in FIG. 4B), or may be any angle in-between. In addition, the mounting slot 20*a,b* may itself be a generally straight line slot or may be angled or curved. As would be understood by those of skill in the art, other configurations of the mounting slot 20*a,b* may be utilized to achieve the desired functionality as described herein, and such other configurations are anticipated for use in conjunction with the present invention.

Figure 5A:
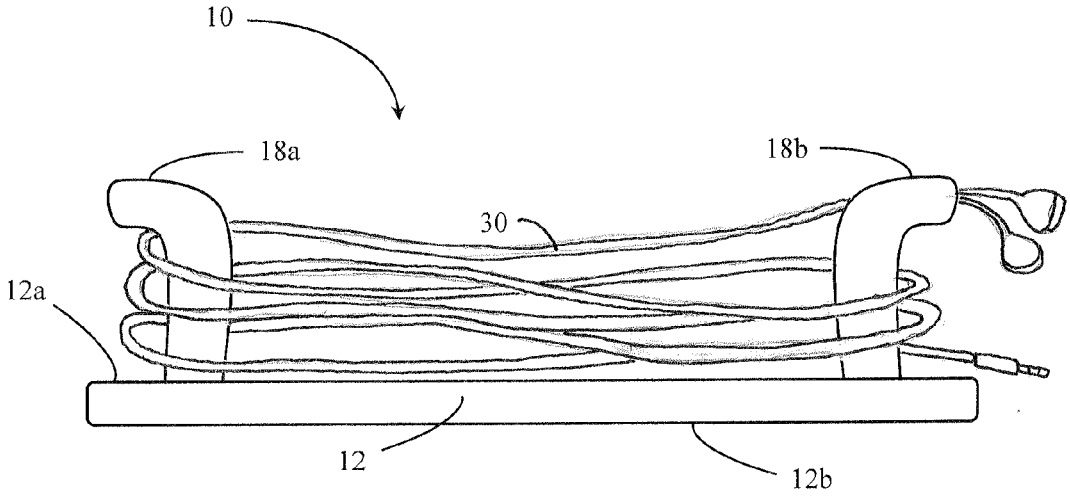
FIG. 5A is a side view of the cord organizer with a cord wrapped thereabout, according to one aspect of the present invention.
Figure 5B:
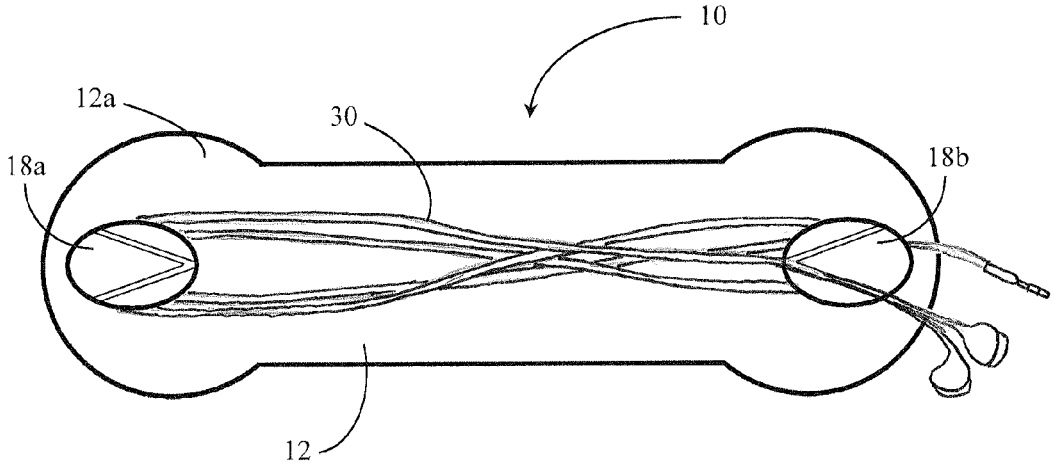
FIG. 5B is a side view of the cord organizer with a cord wrapped thereabout, according to one aspect of the present invention.

FIGS. 5A and 5B show the cord organizer 10 in use or operation with a representative cord 30 (e.g., such as an earphone cord or electrical cord) stowed on the cord organizer 10. To stow the cord 30 a user wraps the cord around each post 14*a,b* (not shown in this figure but as is evident, the post is underneath and supporting the flexible nub) and flexible nub 18*a,b* in an alternating fashion from end to end. To take full advantage of the design and configuration of the cord organizer 10 of the present invention, the user additionally crosses the cord over itself when passing from one post and nub to the other, thus forming a generally "figure-8" pattern. More specifically, the user may start at one post 14*a* and flexible nub 18*a* and extend the cord to the other post 14*b* and flexible nub 18*b*, where the user passes the cord around the post 14*b* and flexible nub 18*b* and then extends the cord 30 back toward the first post 14*a* and flexible nub 18*a*, crossing over the cord 30 along the way, forming a "figure-8" pattern. The user may continue wrapping the cord around each post 14*a,b* and flexible nub 18*a,b* until the end of the cord 30 is reached. When the end is reached, the cord 30 may then be pressed into the nearest mounting slot 20*a,b* in the desired angled direction (if applicable). This will frictionally hold the cord 30 in place on top of the flexible nub 18*a,b* until it is desired to be un-stowed. Alternatively, the user may press any portion of the cord 30 into the nearest mounting slot 20*a,b* at an interim length of cord 30 to result in a partially stowed cord 30.

Figure 6:
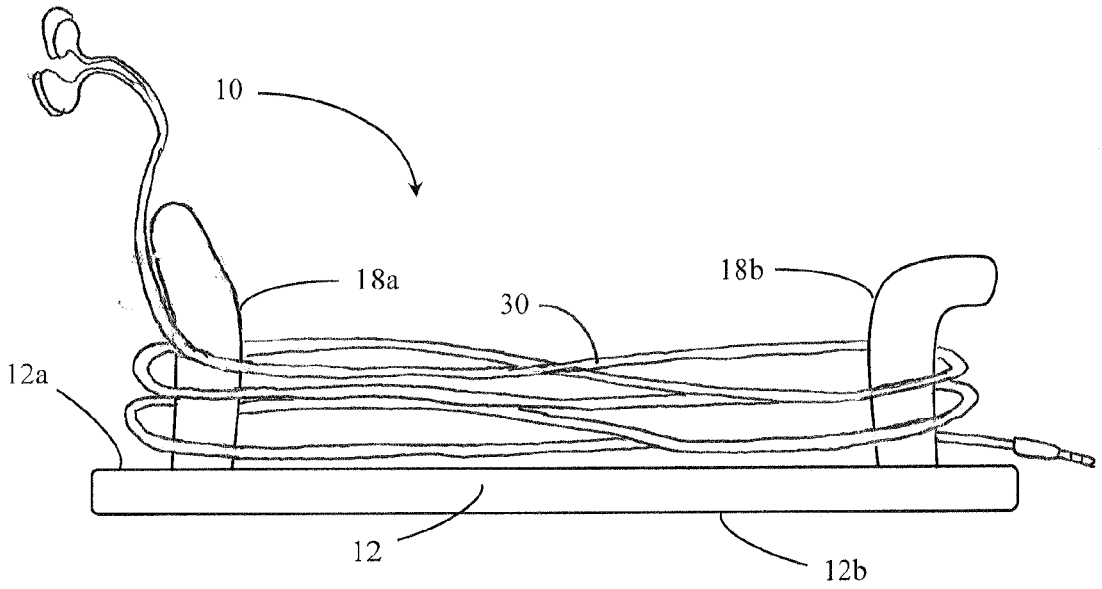
FIG. 6 is a diagrammatic illustration of the cord organizer in use with the cord being pulled off of the organizer and the nub flexing, in accordance with one example embodiment of the present invention.

Upon the user desiring to un-stow the cord 30, the user simply pulls the cord 30 out of the mounting slot 20*a,b* and further pulls the cord 30 off of the posts 14*a,b* and flexible nubs 18*a,b*, straightaway. Because of the capability of the flexible nubs 18*a,b* to flex, they will flex and elastically deform to at least partially straighten out the generally elbow shape to a straighter position as shown in FIG. 6. This enables the user to very quickly and easily remove the cord 30 from the cord organizer 10, without the cord 30 becoming stuck on the ledge 26*a,b* and requiring the user to make excessive twisting and turning movements of the cord organizer 10 in order to remove the cord 10. Furthermore, because of the "figure-8" pattern that is possible with the configuration of the present invention, when the cord 30 is removed in this fashion, it does not become twisted about its central longitudinal axis. The user may un-stow the entire cord 30 or may stop part way through the removal from the cord organizer 10 and press the cord back into one of the mounting slots 20*a,b*, with the cord 30 being partially stowed. This allows the user to adjust the length of the cord 30 that is available for extension and use from the cord organizer 10, vs. the quantity of the cord 30 that remains stowed on the cord organizer 10. One of skill in the art will further appreciate that once the cord passes the flexible nubs 18*a,b*, the elastic properties of the flexible nub cause it to return to the original shape in such a way as to provide a mechanism to hold any remaining cord in place on the posts 14*a,b*.

Figure 7:
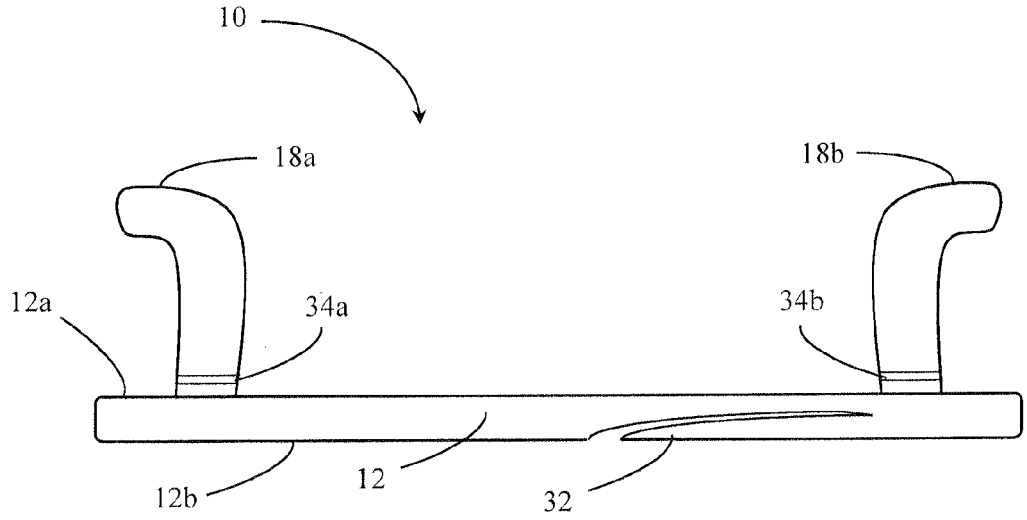
FIG. 7 is a diagrammatic illustration of various accessories configured in conjunction with the cord organizer, in accordance with example embodiments of the present invention.

In accordance with one example embodiment of the present invention, and as shown in FIG. 7, a belt clip 32 can be provided on a back side of the base 12. The belt clip 32 can be formed integrally with the base 12, or can be attached to the base 12. Furthermore, the belt clip can be simply a slot formed in the base 12, can be an angled surface that extends from the base 12, can be a separate spring-loaded pivoting clip, or can be another variation of clip as would be understood by those of skill in the art. Furthermore, there may be a single belt clip 32 or a plurality of clips in different orientations on the base 12, such that the present invention is by no means limited to the particular number, or style, of belt clip 32 displayed in the figures or described herein.

In accordance with one example embodiment of the present invention, and as shown in FIG. 7, a base slot 34*a,b* can be provided in a base portion of the post 14*a,b*, or the flexible nub 18*a,b*. The base slot 34*a,b* can have a very similar, or the same, configuration as the mounting slots 20*a,b*, but be positioned differently. The cord can be pressed into a base slot 34*a,b* as a first step in stowing the cord, prior to extending the cord to an opposite post and beginning the wrapping process. Likewise, the cord can be pressed into the base slot 34*a,b* when the cord is completely un-stowed, but the user wishes to attach the cord organizer 10 to the cord 30 to store it for later use. Thus, the base slot 34*a,b* can serve to mount the cord organizer 10 to a completely un-stowed cord 30 for later use. The base slot 34*a,b*, in accordance with one embodiment of the present invention, is located on opposite sides of each flexible nub 18*a,b* and/or post 14*a,b*, in such a way that the base slot 34*a,b* can be easily located and utilized from either side or end of the cord organizer (i.e., a total of four base slots 34*a,b*, two on each post 14*a,b*).

Figure 8:
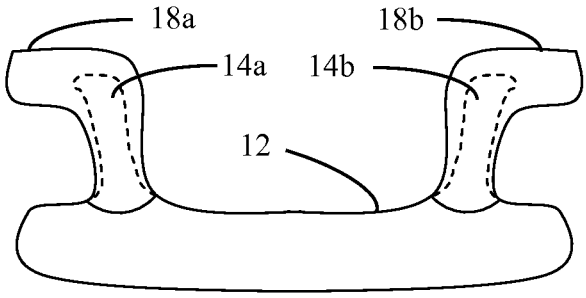
FIG. 8 is a diagrammatic illustration of a cord organizer in accordance with aspects of the present invention.

In accordance with yet another example embodiment of the present invention, all of the above features and functionality can be implemented in alternative structures with some of the same components. More specifically, and as shown in FIG. 8, the first and second posts 14*a,b* can be more integrally formed with the base 12 to give more of an appearance of a single shape rather than posts extending from a base. One of skill in the art will still recognize the base 12 area and the posts 14*a,b* as they equate to the other embodiments of the present invention as described herein.

Figure 9:
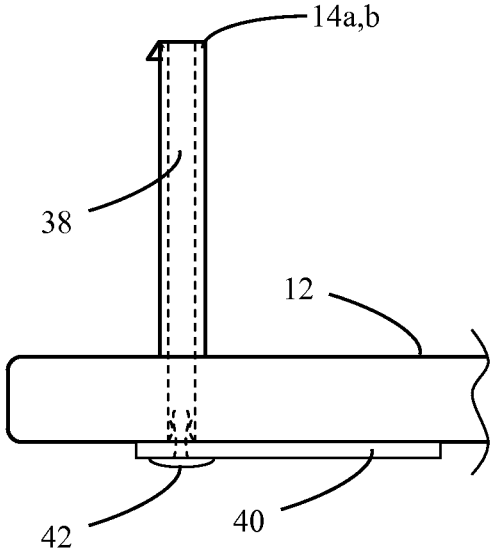
FIG. 9 is a cross-sectional side view of one end of an example cord organizer with a hollow channel passing through a post, in accordance with one example embodiment of the present invention.

In accordance with yet another example embodiment of the present invention, as shown in FIG. 9, a channel 38 is formed through the base 12 and into each post 14*a,b*. The channel 38 may be utilized as a mounting aperture to mount numerous different accessory components to the cord organizer 10, or can be used to mount the cord organizer to a surface. For example, as mentioned above, an accessory belt clip may be mounted to the cord organizer 10. The accessory belt clip 40 may be held with two interference fit fasteners 42, one through each channel 38 of each post 14*a,b*. A user may press the fasteners 42 into the channel 38 to clip them in place, as would be understood by those of skill in the art. Likewise, other conventional fastening mechanisms that would be operational with a similar channel 38 type of structure, including a threaded fastener, a detent implementation with a fastener, and the like, may be utilized to couple the fastener 42 into the channel 38 and hold any number of accessory or auxiliary devices (such as belt clips) in place against the base 12 of the cord organizer 10. Furthermore, the channel 38 may be utilized to hold a screw or nail passing completely therethrough to mount the entire cord organizer against a wall or other structure.

Numerous modifications and alternative embodiments of the present invention will be apparent to those skilled in the art in view of the foregoing description. Accordingly, this description is to be construed as illustrative only and is for the purpose of teaching those skilled in the art the best mode for carrying out the present invention. Details of the structure may vary substantially without departing from the spirit of the present invention, and exclusive use of all modifications that come within the scope of the appended claims is reserved. It is intended that the present invention be limited only to the extent required by the appended claims and the applicable rules of law.

It is also to be understood that the following claims are to cover all generic and specific features of the invention described herein, and all statements of the scope of the invention which, as a matter of language, might be said to fall therebetween.

What is claimed is:

1. A cord organizer, comprising:

a base having a bottom surface and a top surface;

a first post extending outward from the top surface of the base;

a second post extending outward from the top surface of the base;

a first flexible nub mounted to the first post; and a second flexible nub mounted to the second post;

wherein the first and second flexible nubs are configured in such a way as to extend outward from the first and second posts, respectively, at post ends distal from the base forming a ledge hindering a cord wrapped about the first and second posts from sliding off an end of the first and second posts opposite the base while also having sufficient flexibility to substantially remove the ledge by a flexing action out of the way when the cord wrapped about the first and second posts is forcibly pulled off of the cord organizer.

2. The cord organizer of claim 1, wherein the first and second posts extend substantially perpendicularly from the top surface of the base.

3. The cord organizer of claim 1, wherein the first and second posts extend outward and at a non-perpendicular angle from the top surface of the base.

4. The cord organizer of claim 1, wherein the cord organizer further comprises a clip configured to mount the cord organizer to another object.

5. The cord organizer of claim 1, further comprising at least one mounting slot disposed in a top portion of the first flexible nub, the second flexible nub, or both, configured to receive and hold the cord stowed on the cord organizer.

6. The cord organizer of claim 1, further comprising a first mounting slot and a second mounting slot disposed in the first flexible nub, the second flexible nub, or both, configured to receive and hold the cord stowed on the cord organizer.

7. The cord organizer of claim 1, further comprising a base mounting slot formed in the first post, the second post, the first flexible nub, the second flexible nub, or any combination thereof, proximal to the base.

8. The cord organizer of claim 1, further comprising a hollow channel passing through at least one of the first and second posts along a central axis thereof.

9. The cord organizer of claim 8, further comprising a fastener removably coupled with the hollow channel to mount a component accessory to the cord organizer.

10. A method of removing a cord from a cord organizer, comprising:

providing a cord organizer in accordance with claim 1 having the cord wrapped in a figure-eight pattern about the first and second posts;

a user pulling the cord straight away from the cord organizer, causing the cord to pull past the first and second nubs causing the first and second flexible nubs to flex and elastically deform enabling the cord to slide off of ends of the first and second posts and be removed from the cord organizer.

11. The method of claim 10, further comprising pulling the cord out of a mounting slot prior to or simultaneous with pulling the cord straight away from the cord organizer.

12. The cord organizer of claim 1, wherein the first flexible nub is removably and replaceably mounted to the first post.

13. The cord organizer of claim 1, wherein the second flexible nub is removably and replaceably mounted to the second post.

* * * * *